United States Patent [19]

Holmes

[11] 4,126,265

[45] Nov. 21, 1978

[54] PRODUCE CONTAINERS

[75] Inventor: Gordon W. Holmes, Mississauga, Canada

[73] Assignee: Professional Packaging Limited, Mississauga, Canada

[21] Appl. No.: 867,378

[22] Filed: Jan. 6, 1978

[30] Foreign Application Priority Data

Jan. 6, 1977 [GB] United Kingdom ..... 00443/77

[51] Int. Cl.[2] ..... B65D 5/26

[52] U.S. Cl. ..... 229/32; 229/35; 229/49; 206/821

[58] Field of Search ..... 229/32, 35, 52 A, 49; 206/821

[56] References Cited

U.S. PATENT DOCUMENTS

| | | | |
|---|---|---|---|
| 207,347 | 8/1878 | Cole | 229/35 |
| 775,090 | 11/1904 | Pilz | 229/49 |
| 1,147,975 | 7/1915 | Ruff | 206/821 X |
| 1,174,364 | 3/1916 | Stempel | 229/32 X |
| 2,271,962 | 2/1942 | Weiner | 229/32 X |
| 2,289,824 | 7/1942 | Brogden | 229/52 A |
| 2,352,994 | 7/1944 | Morgan | 229/35 |
| 2,405,564 | 8/1946 | Evans | 229/35 X |
| 2,660,363 | 11/1953 | Trickett, Jr. | 229/35 |
| 3,226,008 | 12/1965 | Chiorri | 229/32 X |
| 3,767,109 | 10/1973 | Paige | 229/43 |

*Primary Examiner*—Davis T. Moorhead
*Attorney, Agent, or Firm*—Sim & McBurney

[57] ABSTRACT

Collapsible produce containers are described which have many advantages over existing structures. One embodiment is directed to a produce basket which comprises a collapsible tray which can be folded flat and a handle which is releasably connected to the side walls of the tray when the latter is in its non-collapsed form. Another embodiment is directed to a stackable collapsible tote box primarily used for carrying a plurality of the containers of the first embodiment which has releasably joined cornerbrace members which include support surfaces for a similar tote box stacked thereon.

9 Claims, 10 Drawing Figures

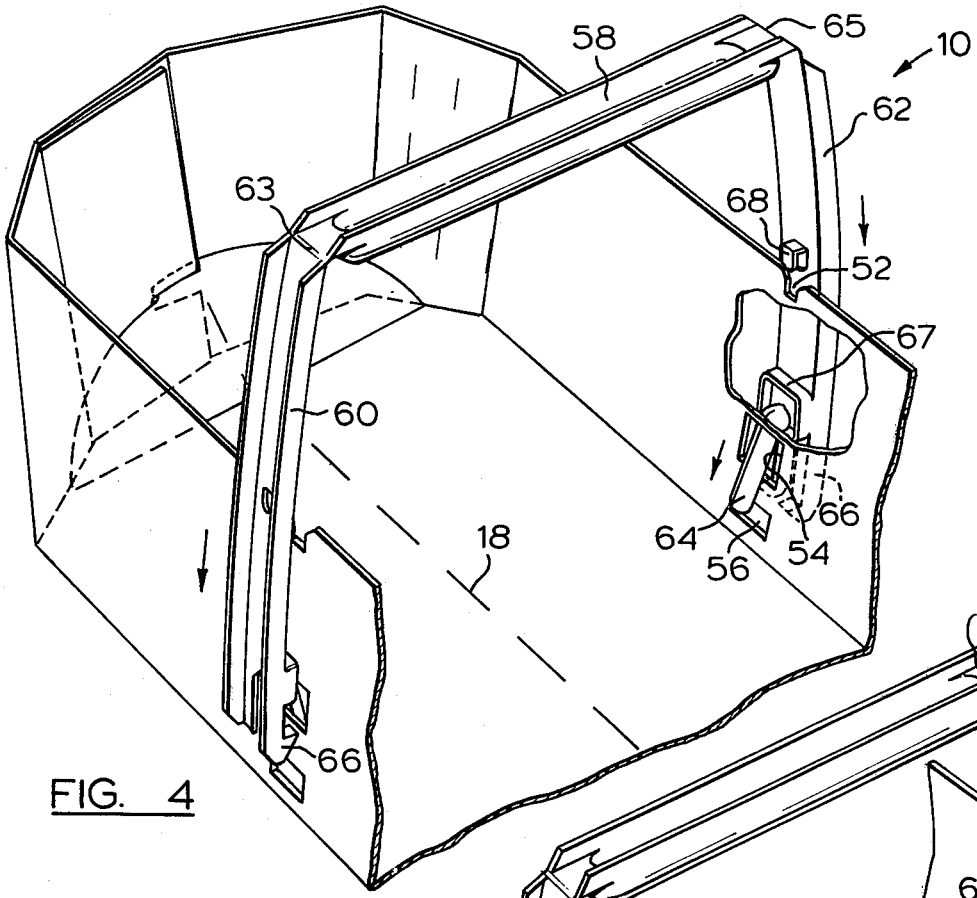
FIG. 4
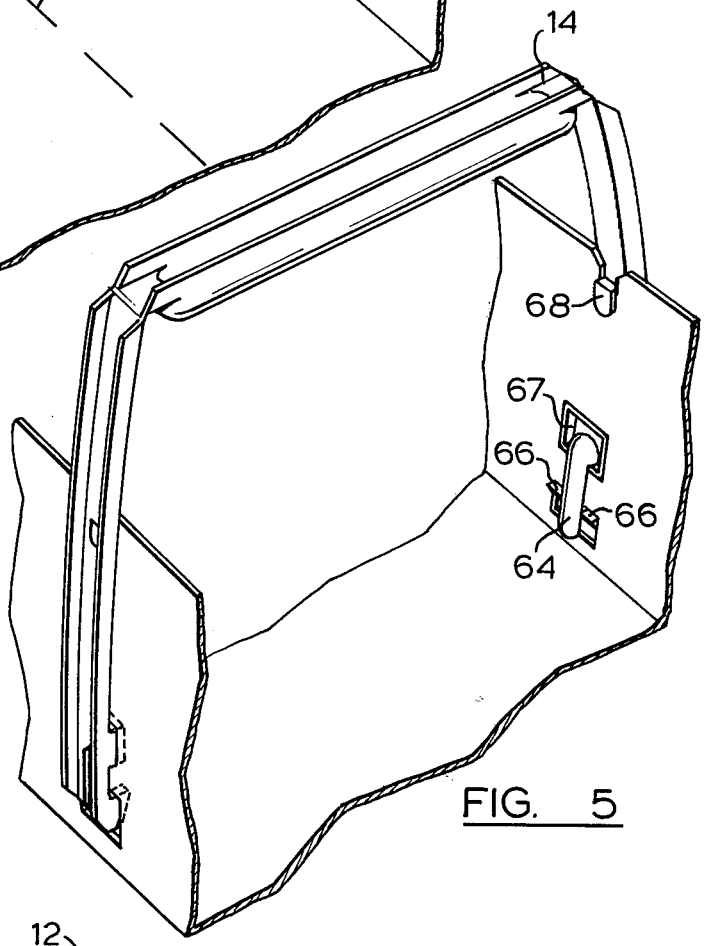
FIG. 5
FIG. 3
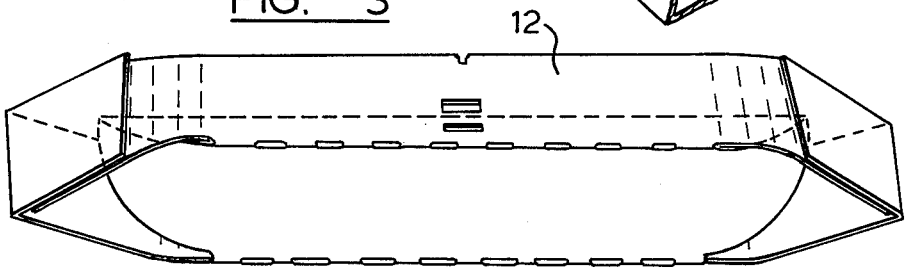

PRODUCE CONTAINERS

FIELD OF INVENTION

This invention relates to produce containers.

BACKGROUND OF THE INVENTION

It is conventional for bulk quantities of fruit or other produce to be packaged for sale in preformed rigid baskets comprising a laminated wood or corrugated cardboard tray having a laminated wood handle stapled or otherwise permanently attached to the sides of the tray. Such baskets are bulky and consume large spaces during transport and storage when empty.

It is also conventional to transport pluralities of such baskets when full in permanently formed trays or tote boxes which are intended to be stacked one on another for ease of transportation of the full baskets without damage to the produce. The trays also are bulky and consume large spaces during transport and storage when empty.

SUMMARY OF INVENTION

The present invention is directed to an improved produce basket which is disassemblable and collapsible for storage and transport when empty and comprising a collapsible tray and a releasable handle which is connected to the side walls of the tray.

Since the tray can be stored in a collapsed condition which occupies very little space and the handle may be releasably connected with the tray to form the basket, the basket which is provided by this invention does not exhibit the bulkiness and storage space utilization problems of the prior art produce containers.

The present invention further provides a collapsible reusable and stackable tote box for transportation and in-store display of multiple numbers of full produce baskets and comprising an open-topped box having releasably joined cornerbrace members which maintain the box in its assembled condition and includes a support surface for the next higher box in a stack.

The provision of a tote box of this type in place of the permanent non-collapsible structures of the prior art overcomes the storage space problems associated with the prior art structures.

BRIEF DESCRIPTION OF DRAWINGS

FIG. 3 is a perspective view of a collapsed form of the tray of FIG. 2 which has been slightly opened to portray the structure;

FIG. 4 is a perspective view, with parts broken away for clarity, illustrating the assembly of the basket handle with the tray portion;

FIG. 5 is a perspective view of a detail of an assembled produce package according to the one embodiment of the invention;

DESCRIPTION OF PREFERRED EMBODIMENTS

Referring first to FIGS. 1 to 5 of the drawings, one embodiment of a novel reusable collapsible produce basket in accordance with the invention is shown. The basket 10 comprises a collapsible tray 12 and a releasable handle 14.

Figure 1:
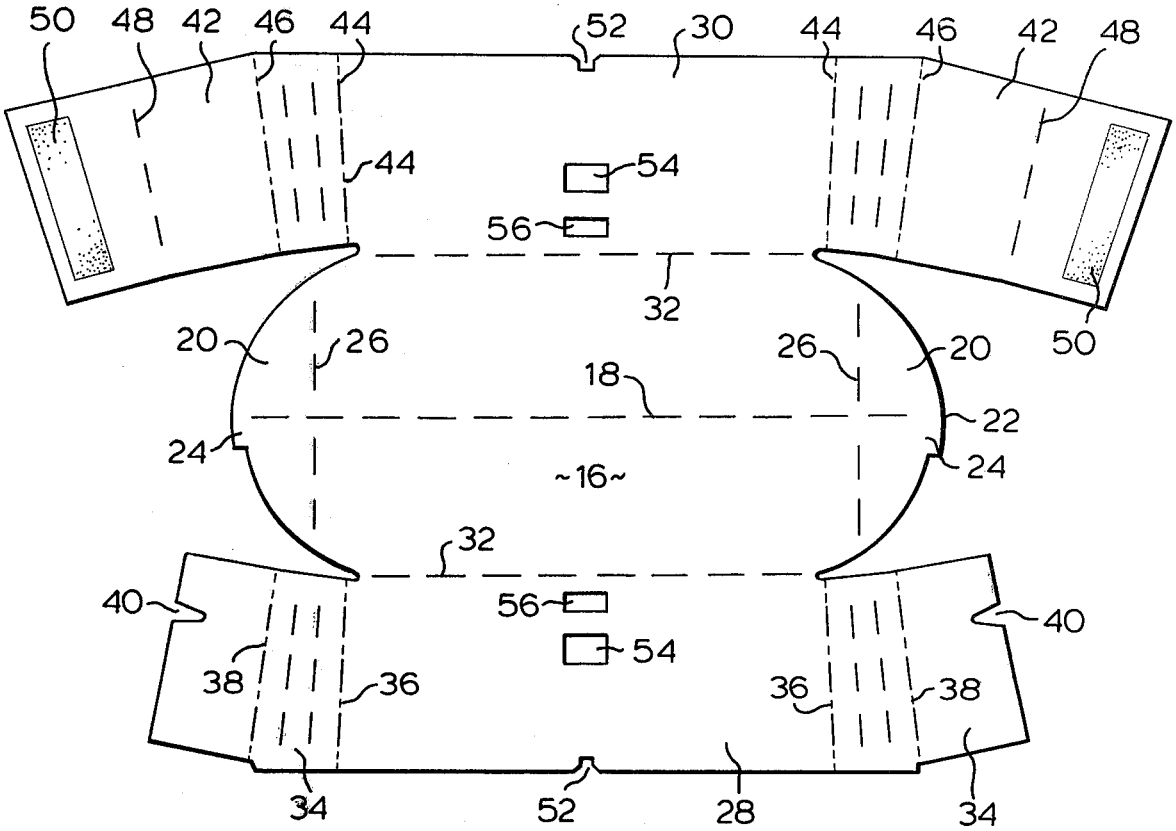
FIG. 1 is a plan view of a blank of the tray portion of one embodiment of a produce basket provided in accordance with one aspect of the invention.

The blank for the tray 12 is shown in FIG. 1 and comprises a centre panel 16 having a longitudinal fold line 18 and end panels 20 each having a generally arcuate periphery 22 with a step 24 therein. Transverse fold lines 26 are provided in each end panel 20.

Side panels 28 and 30 are joined to the centre panel 18 along fold lines 32. The side panel 28 has a pair of identically constructed end panels 34 joined thereto along fold lines 36. Each end panel 34 has two approximately equally dimensioned portions separated by fold line 38 and has a notch 40 at its longitudinal extremity.

The side panel 30 has a pair of identically constructed end panels 42 joined thereto along fold lines 44. Each end panel 42 has three approximately equally dimensioned portions joined to each other along fold lines 46 and 48. The longitudinally extreme portions of the end panels 42 have suitable adhesive 50 thereon for attachment to the longitudinally extreme portions of the end panels 34 on assembly of the blank to form the tray 12.

A notch 52 is provided in the longitudinal free edge of each side panel 28 and 30 at the approximate midpoint along its length. A pair of openings 54 and 56 also is provided through each of the side panels 28 and 30 adjacent the fold line 32 and in lateral alignment with the notches 52.

Figure 2:
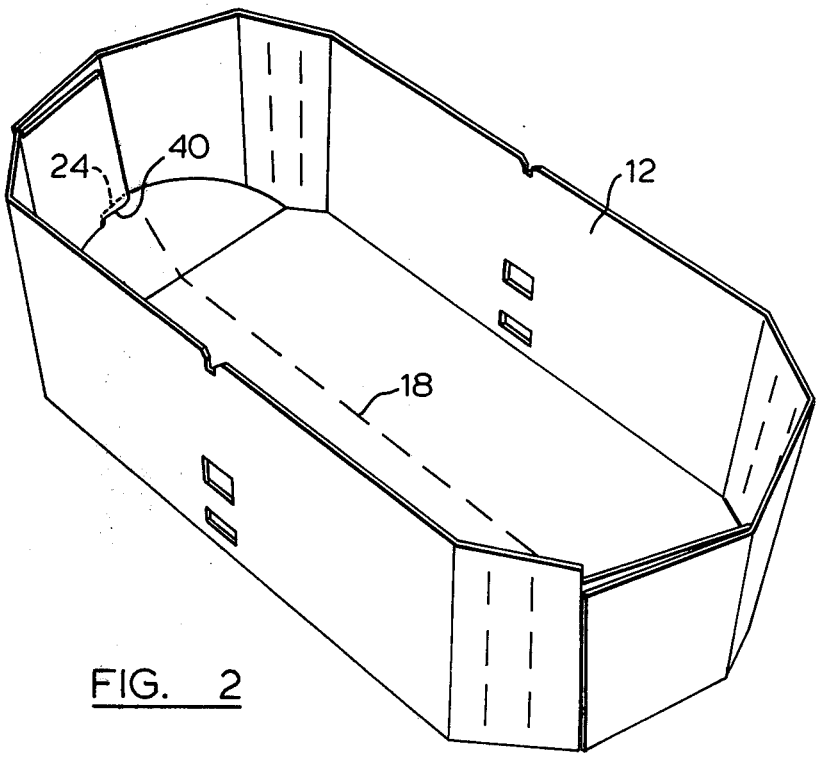
FIG. 2 is a perspective view of the tray portion assembled from the blank of FIG. 1.

The blank shown in FIG. 1 is assembled into the tray 12 of FIG. 2 by bending the end panels 20 upwardly about the fold lines 26, bending the side panels 28 and 30 upwardly about the fold lines 32, bending the end panels 34 inwardly about the fold lines 36 and 38, bending the end panels 42 inwardly about the fold lines 44, 46 and 48 so that the longitudinally extreme portion of each end panel 42 overlaps and engages the respective longitudinally extreme portion of the end panel 34 and adhesively joining the overlapping portions. To complete the tray 12 and prevent it from accidentally collapsing by bending about fold line 18, the end panels 20 are pressed down about fold line 26 until the steps 24 releasably lock into the respective notch 40.

The tray 12 may be collapsed for shipping and storage, by releasing the lock between the steps 24 and notches 40 and pushing the centre panel 16 inwardly of the tray 12 to fold about the longitudinal fold line 18. The side panels and joined end panels collapse towards each other as shown in FIG. 3, until a substantially flat structure is provided. The non-collapsed form of the tray 12 as shown in FIG. 2 may be restored by reversing the bending operations and re-engaging the steps 24 and notches 40.

In practice, rapid assembly or erection of the tray 12 is accomplished by one downward motion of the hand along the interior centre fold line 18 as the folded blank is placed on any flat, smooth surface.

The tray 12, therefore, is capable of collapsing and reassembly many times without impairing the integrity of the physical structure of the tray. Thus, once the tray 12 is assembled from the blank as described above, assembly or disassembly thereof requires only the folding of the walls and base of the tray.

The structure of the tray 12 contrasts markedly with prior art produce baskets wherein a permanent non-collapsible tray and basket is provided. The collapsed or folded form of the tray 12 shown in FIG. 3 occupies little space as compared with the non-collapsed form of the tray shown in FIG. 2 and hence multiple numbers of the collapsed form of the tray 12 may be stored and shipped without occupying the space of conventional trays.

The handle 14 is releasably connected to the tray 12 and usually is constructed of plastic material. The handle 14 is comprised of a semi-rigid or rigid centre elongate portion 58 which extends transversely of the tray 12 and two depending semi-rigid or rigid elongate portions 60 and 62 which are hingedly joined to the centre portion 58 at hinges 63 and 65 respectively. Since the component parts of the handle 14 are hingedly joined, multiple numbers are readily stored and transported as elongate bodies.

The depending portions 60 are identically constructed and include parts for releasably locking the handle 14 securely to the tray 12. At the lower end of each depending portion 60, 62 is a resiliently-connected depending finger 64 which is offset inwardly from and extends parallel to the axis of the respective depending portion 60, 62 and which, during assembly of the handle 14 with the tray 12 in its non-collapsed form, projects inwardly through the opening 54 in the side wall 28, and a pair of inwardly directed downwardly tapering projections 66 having flat upper faces which snap into the opening 56 under the spring action of the finger 64. The interaction of the flat upper surfaces of the projections 66 with the opening 56 prevents accidental release of the handle 14 by upwardly directed forces. A projection 67 is provided on the inner surface of each depending portion 60, 62 to engage with the opening 54 when the handle 14 and tray 12 are assembled.

The depending portions 60 and 62 also each has an inwardly directed flange 68 opening downwardly for engagement with the notch 52. The interaction of each notch 52 with the respective flange 68 limits downward movement of the handle 14 and also prevents movement of the handle 14 longitudinally of the tray 12.

The latter interaction combined with the interactions of the fingers 64 and projections 67 with the openings 54 and of the projections 66 with the openings 56 provide a rigid attachment of the handle 14 to the tray 12 to provide the novel produce basket. The handle 14 may be released by deliberate removal of the projections 66 from the openings 56, if desired. The assembly of the handle 14 with the tray 12 is shown in FIG. 4 while the assembled relationship of the handle 14 with the tray 12 is shown in FIG. 5.

The use of a releasable handle 14 in the basket 10 represents an additional departure from prior art structures wherein the handle is permanently affixed to the tray. The ability of the handles 14 to be stored and transported as elongate bodies enables them to be compactly bundled.

The produce basket provided in accordance with this invention and illustrated in FIGS. 1 to 5, therefore, differs significantly from conventional produce baskets and has significant advantages, including reusability, greater strength, color coordination and a sliver free structure, not possessed by the conventional baskets.

Figure 6:
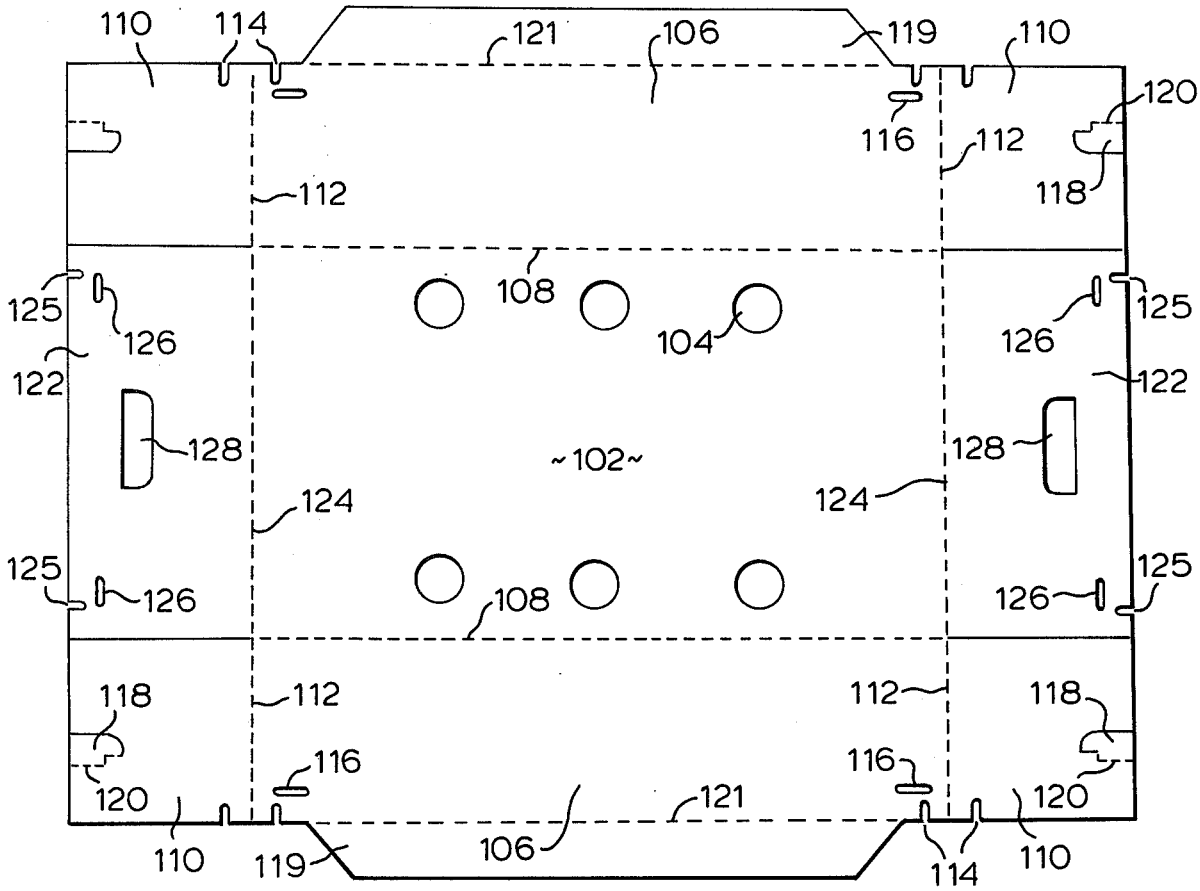
FIG. 6 is a plan view of a blank for one embodiment of a collapsible reusable tote box in accordance with another aspect of the invention.
Figure 8:
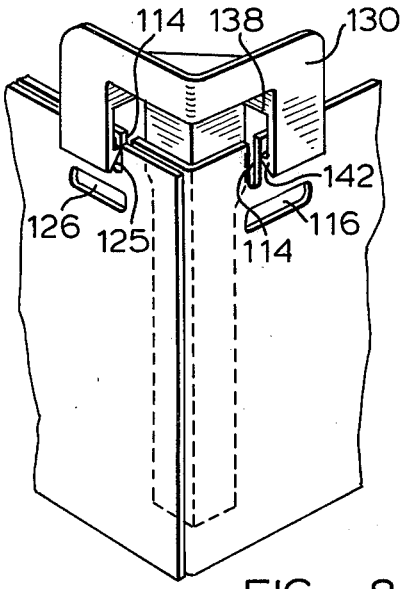
FIGS. 8 and 9 are perspective views of one corner of the assembled tray of FIG. 6 showing the positioning of cornerbrace pieces.
Figure 9:
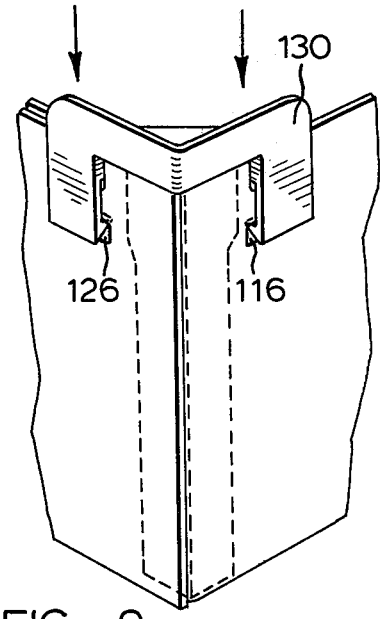
Figure 10:
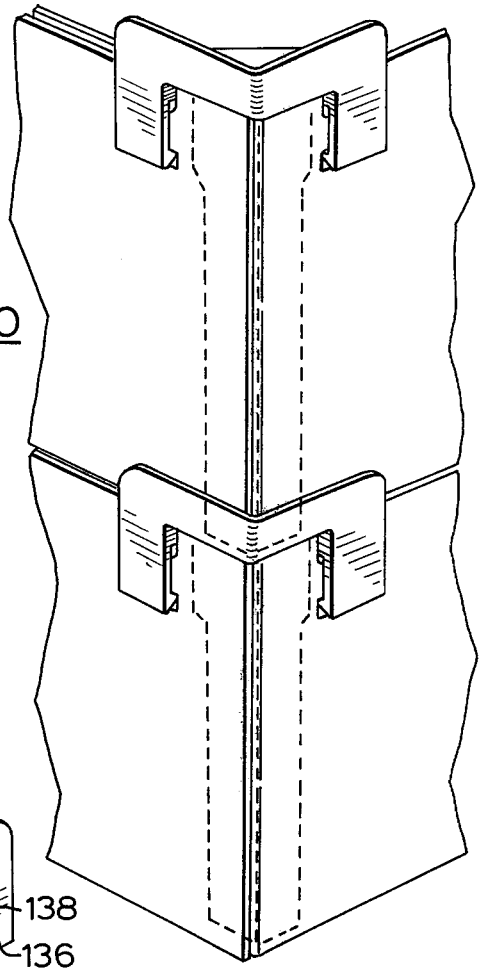
FIG. 10 is a perspective view of the one corner of two superimposed trays.

Turning now to consideration of FIGS. 6 to 10, there is illustrated one embodiment of a tote box 100 for the transportation and storage of multiple numbers of produce baskets. The blank for forming the tote box 100 is shown in FIG. 6. As shown therein, the blank includes a centre panel 102 having a plurality of openings 104 therein to allow for air circulation. Side panels 106 are joined to the centre panel 102 along fold lines 108.

Each side panel 106 has two end panels 110 joined thereto along fold lines 112. On each side of and parallel to each fold line 112 at the longitudinal edge of the blanks is located a pair of inwardly extending notches 114. Extending through each side panel 106 adjacent one member of the pair of notches 114 therein and transverse thereto is a longitudinally-extending slot 116.

At the longitudinal end of each end panel 110 is formed a cut out 118 which is attached to the end panel 110 along fold line 120.

Each side panel 106 has a longitudinally-extending tab 119 joined thereto along fold lines 121. The purpose of these tabs 119 will become more apparent below.

End panels 122 are provided at each end of the centre panel 102 and are joined thereto along fold lines 124. Each end panel 122 has an inwardly-extending notch 125 formed adjacent and parallel to the lateral extremity thereof and a transversely directed slot 126 formed adjacent and transverse to the notch 125. Elongate handhole openings 128 are formed through the end panels 122.

The blank of FIG. 6 is assembled to form the tray 100 by bending the end panels 110 upwardly about the fold lines 112 and bending the side panels 106 upwardly about the fold lines 108. The end panels 122 are folded upwardly about the fold lines 124 to engage the end panels 110. The tabs 119 are bent about fold lines 121 inwardly to extend parallel to the base 102.

Figure 7:
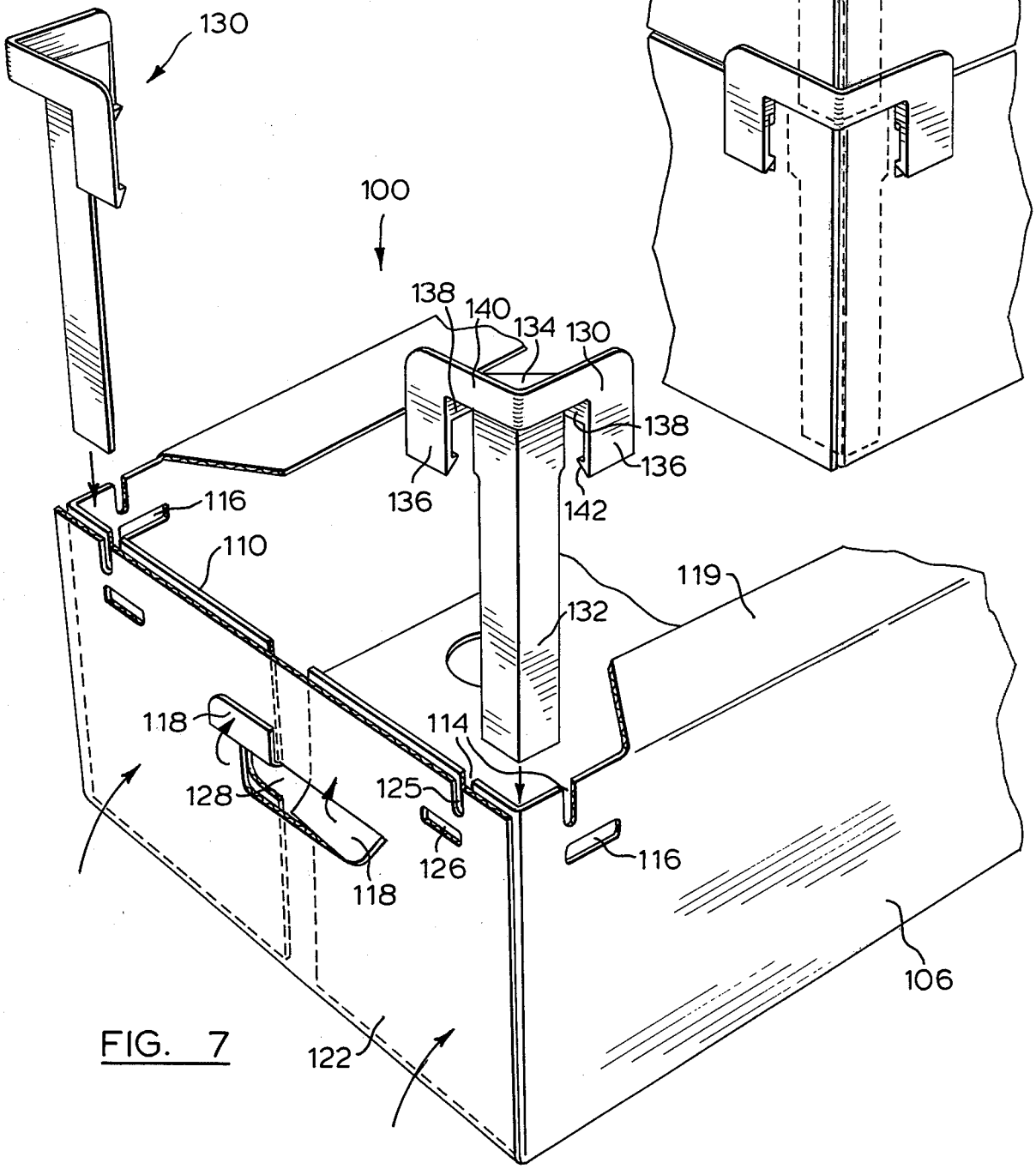
FIG. 7 is a perspective view of one end of a tray assembled from the blank of FIG. 6 and showing cornerbrace pieces in exploded condition.

The cut-outs 118 then are projected through the adjacent handhole 128, as seen in FIG. 7, to achieve temporary stability to the tray 100. The notch 114 in the end panel 110 and notch 125 in the end panel 122 are aligned, in effect forming a single notch.

An integrally formed cornerbrace member 130 is provided at each corner of the tray 100 to provide rigidity to the tray and to provide a rigid bearing surface at each corner for stacking the trays 100 one on another. The cornerbrace member 130 includes a leg 132 which extends the depth of the tray 100 into engagement with the base 102 at its lower end when assembled and has right-angularly joined surfaces for engagement with the inner walls of the tray 100 at the corner when assembled.

The cornerbrace member 130 also possesses a triangular planar upper surface 134 for stacking of multiple numbers of tote boxes 100. Depending skirt members 136 extend parallel to the adjacent surface of the leg 132 and are connected to the leg 132 through thin webs 138 extending perpendicular to the leg 132 and the skirt member 136 and are connected to the planar upper surface 134 through wall members 140 upstanding from and surrounding the flat surface 134 to act as guide and stop members when the boxes are stacked. The lower end of the skirts 136 include inwardly-projecting downwardly-tapered projections 142 having flat upper surfaces.

The cornerbraces 130 are inserted and lock into the corners of the tray 100 by outward flexing of the skirts 136 upon engagement of the projections 142 with the walls 106 and 122 until the projections 142 snap into the respective openings 116 and 126 and by entry of the webs 138 into the notches 114 and 125. A rigid stable tray 100 is thereby provided. The tray 100 may be readily collapsed for storage, or shipment, by removal of the cornerbraces 130 and release of the cut outs 118 from the handholes 128.

The tote box 100 therefore, may readily be stored and transported when not in use in a non-bulky form but may be readily assembled into a strong rigid stackable structure using the integral cornerbrace members.

The tray 100 may be dimensioned to receive a plurality of produce baskets, typically those illustrated in FIGS. 1 to 5, in any desired orientation. Trays 100 may be readily stacked one on another, as may be seen from FIG. 10.

Modifications are possible within the scope of the invention.

What I claim is:

1. A produce container, comprising a collapsible tray which has a generally flat planar structure in its collapsed form and has a base, side and end walls upstanding from the base and an open top in its non-collapsed form, said tray being constructed to permit change between its collapsed and non-collapsed forms to be effected without destruction of the integrity of the elements constituting said base and said side and end walls, and an integrally-formed handle comprising a first elongate portion extending transverse to the open top of the tray and constituting a grip for the handle and first and second elongate depending portions hingedly connected to said first portion one at each end thereof, said handle being releasably connected with the side walls of the tray in its non-collapsed form by the interaction of projections formed at the lower end of each said depending portion with cooperating openings formed in the respective side wall of the tray, said side wall openings comprising first and second vertically-aligned generally rectangular openings formed adjacent said base, said projection including a resilient dependent finger-like projection formed parallel to said depending portion and extending through the upper of said vertically-aligned openings and downwardly internally of said side wall and inwardly-projecting projections extending through the lower of said vertically-aligned openings in interference relationship with said opening, said resilient finger-like projection constraining said inwardly-projecting projections from removal from said lower opening.

2. The container of claim 1 wherein said base has a fold line extending longitudinally thereof to permit said base to be folded inwardly of said tray, said side walls are joined to said base and said end walls along fold lines and said end walls are physically separate from said base and have vertical fold lines therein.

3. The container of claim 2 including stabilizing means associated with said base and engaging said end walls to maintain said tray in its non-collapsed form.

4. The container of claim 3 wherein said stabilizing means comprises tab means hingedly joined to said base and notch means in each said wall for receiving said tab means in locking engagement.

5. The container of claim 1 wherein said inwardly-projecting projections include spaced-apart downwardly tapering projections and said finger-like projection extends downwardly between said spaced-apart projections.

6. The container of claim 1 including a notch formed in the upper edge of each side wall and a downwardly opening flange formed on each said depending portion into engagement with said notch to inhibit movement of said handle longitudinally of said tray when said container is assembled.

7. A stackable, collapsible tote box, comprising a rectangular base, side and end walls upstanding from the base and an open top, the side and end walls being foldably joined to said base for collapsing said box to a generally planar structure, and an integrally-formed cornerbrace member located at and releasably joined to each corner of the box and having a leg portion extending for just the height of said side and end walls and comprising right-angularly joined walls engaging the inner surfaces of the side and end walls and the base as the respective corner, said corner brace member further having a triangularly-shaped top planar portion at the upper end of said leg portion and constructed to support the lower corner of another such tote box stacked thereon and having an upstanding wall formed at the outer periphery thereof parallel to said side and end walls, each said side and end wall adjacent each corner having formed thereon downwardly-extending notches and transverse slots adjacent the lower end of each said notch, said top planar portion of said cornerbrace member including skirt members depending from said upstanding wall below said top planar portion and each terminating in an inwardly directed projection engaging the adjacent transverse slot, said cornerbrace member including webs extending between the respective skirt member and leg wall perpendicularly with respect thereto and extending into the adjacent notch.

8. The tote box of claim 7, wherein said side walls have flaps foldably joined thereto and extending parallel to and in engagement with the adjacent end wall, said end walls have handhole openings formed therein and each said flap has a tab projecting through said handhole opening in interference fit therewith.

9. The tote box of claim 7 including longitudinal inwardly-directed tabs joined to the upper end of each said side wall and extending generally parallel to said base.

* * * * *